US005600421A

United States Patent [19]

Takekoshi et al.

[11] Patent Number: 5,600,421

[45] Date of Patent: Feb. 4, 1997

[54] IMAGE FORMING APPARATUS

[75] Inventors: Nobuhiko Takekoshi, Kawasaki; Takashi Hasegawa, Ageo; Masahiro Inoue, Yokohama; Yoichi Kimura, Kawaguchi, all of Japan

[73] Assignee: Canon Kabushiki Kaisha, Tokyo, Japan

[21] Appl. No.: 305,604

[22] Filed: Sep. 14, 1994

[30] Foreign Application Priority Data

Sep. 17, 1993 [JP] Japan ..... 5-254944
Sep. 9, 1994 [JP] Japan ..... 6-215992

[51] Int. Cl.[6] ..... G03G 15/16

[52] U.S. Cl. ..... 399/66; 399/299; 399/303; 399/310

[58] Field of Search ..... 355/271, 272, 355/273, 274, 277, 326 R, 327, 208

[56] References Cited

U.S. PATENT DOCUMENTS 4,912,515 3/1990 Amemiya et al. .
4,914,737 4/1990 Amemiya et al. .
5,083,167 1/1992 Fukushima et al. .
5,276,483 1/1994 Hasegawa et al. .
5,287,144 2/1994 Takeda ..... 355/208
5,287,149 2/1994 Hoshika ..... 355/208 X
5,300,984 4/1994 Fuma et al. ..... 355/208
5,335,053 8/1994 Hasegawa .
5,337,136 8/1994 Knapp et al. ..... 355/326 R
5,363,178 11/1994 Matsumoto ..... 355/273

*Primary Examiner*—Sandra L. Brase
*Attorney, Agent, or Firm*—Fitzpatrick, Cella, Harper & Scinto

[57] ABSTRACT

The present invention provides an image forming apparatus comprising an image bearing member for bearing an image thereon, and a transfer device for transferring the image from the image bearing member to a recording material at a transfer station. Wherein a limit value of electric power supplied to the transfer device is changed between a case where an imaged portion of the image bearing member is positioned at the transfer station and a case where a non-imaged portion of the image bearing member is positioned at the transfer station.

26 Claims, 10 Drawing Sheets

IMAGE FORMING APPARATUS

BACKGROUND OF THE INVENTION

1. Field of the Invention

The present invention relates to an image forming apparatus wherein an image is formed on an image bearing member and then is transferred onto a recording material to obtain a copy image. For example, the present invention is particularly applicable to color copying machines of electrophotographic type and color printers wherein a plurality of toner images having different colors are successively formed on an electrophotographic photosensitive body and the plural color toner images are successively transferred onto a single sheet in a superimposed fashion to obtain a color image.

2. Related Background Art

In the past, there have been proposed various color image forming apparatuses wherein a plurality of toner images having different colors are successively formed on an image bearing member and such plural color toner images are successively transferred onto a single recording material in a superimposed fashion to obtain a color image. Among them, copying machines of multicolor electrophotographic type are used most popularly.

An example of such a color electrophotographic copying machine will now be briefly explained with reference to FIG. 5. As shown in FIG. 5, the color electrophotographic copying machine includes a photosensitive drum (image bearing member) 1 around which an exposure lamp 21, a first charger 2, a light source (not shown) and a polygon mirror 17 are arranged. A laser beam emitted from the light source is scanned by rotation of the polygon mirror, and scanned light deflected by a reflection mirror is focused on the generatrix of the photosensitive drum 1 through an fθ lens to expose the photosensitive drum, thereby forming latent images for various colors corresponding to an image signal on the photosensitive drum 1 successively.

The latent images for various colors formed on the photosensitive drum 1 are successively developed by a rotatable developing means 3 at a developing station where the photosensitive drum 1 is opposed to the developing means, thereby visualizing the latent images as toner images. The rotatable developing means 3 includes a rotatable table on which a yellow developing device 3*a*, a magenta developing device 3*b*, a cyan developing device 3*c* and a black developing device 3*d* are mounted, and yellow color developer, magenta color developer, cyan color developer and black color developer are supplied from respective developer supply sources to the respective developing devices 3*a* to 3*d* by a predetermined amount. The various color toner images formed on the photosensitive drum 1 are successively transferred onto a recording material 6 supported by a transfer drum (recording material bearing member) 8 at a transfer station where the photosensitive drum 1 is opposed to the transfer drum. The recording material 6 is sent from a recording material cassette 60 to the transfer drum 8 via a pair of resist rollers 13 and then is born on the transfer drum.

As shown in FIG. 6, the transfer drum 6 has a cylindrical frame comprised of a pair of rings 8*b* interconnected by a connection member (frame connection member) 8*c*, and a dielectric sheet 8*a* as a recording material bearing sheet covering a peripheral opening area of the cylindrical frame. The dielectric sheet 8*a* may be formed from a film made of polyethylene terephthalate (PET), polyvinylidene fluoride or polyurethane resin.

Next, the entire operation of the above-mentioned color image forming apparatus will be explained. A photosensitive layer on the photosensitive drum 1 is uniformly charged by the first charger 2, and the charged drum is firstly exposed by laser light modulated by a yellow image signal corresponding to a yellow color in an image on an original, thereby forming an electrostatic latent image corresponding to a yellow image on the photosensitive drum 1. The latent image is brought to the developing station by rotation of the photosensitive drum 1, where the latent image is visualized as a yellow toner image by the yellow developing device 3*a* previously positioned at the developing station.

On the other hand, the recording material 6 from the recording material cassette 60 is sent to the transfer drum 8 via a sheet supply roller, regist rollers 13 and a sheet supply guide and is moved along the transfer drum 8. In this case, an absorption roller of an absorption charge means 22 (which also includes an absorption charger) is urged against the dielectric sheet 8*a* of the transfer drum 8, and at the same time, the recording material is charged by the absorption charger so that the recording material 6 is electrostatically absorbed onto the dielectric sheet 8*a*.

The recording material 6 born on the transfer drum 8 is brought to the transfer station where the photosensitive drum 1 is opposed to the transfer drum, by the rotation of the transfer drum. In the transfer station, a transfer electric field is generated by a transfer charge means 4 (comprising a conductive transfer charge brush contacted with a back surface of the dielectric sheet 8*a* at the transfer station in this example), so that the yellow toner image formed on the photosensitive drum 1 is transferred onto the recording material 6. The transfer drum 8 continues to rotate so that the recording material 6 to which the yellow toner image was transferred is sent to the transfer station again in order to transfer a next magenta toner image onto the same recording material.

On the other hand, after the transferring, the photosensitive drum 1 is cleaned by a cleaning member 5. Then, the photosensitive drum is uniformly charged by the first charger 2 again and then is exposed by laser light modulated by a magenta image signal to form an electrostatic latent image corresponding to a magenta image. The latent image is developed by the magenta developing device 3*b* positioned at the developing station, thereby forming a magenta toner image. The magenta toner image is then transferred onto the recording material at the transfer station in a superimposed relation to the yellow toner image.

By repeating the same operations regarding the cyan color and the black color, the yellow, magenta, cyan and black toner images are superimposed onto the recording material 6, thereby obtaining a color image. After the four color toner images were transferred, the recording material 6 is separated from the transfer drum 8 by a separation pawl and then is sent to a fixing device 7 by a convey belt.

The fixing device 7 comprises a fixing roller 71, a pressure roller 72, heat-resistive cleaning members 73, 74 for cleaning these rollers, and heaters 75, 76 for heating these rollers. A coating roller 77 is contacted with the fixing roller 71 so that mold releasing oil reserved an oil reservoir 78 is coated on an outer peripheral surface of the fixing roller 71 via the coating roller. A thermistor 79 for controlling a fixing temperature is contacted with an outer peripheral surface of the pressure roller 72. The recording material 6 sent to the fixing device 7 is heated and pressurized between the fixing roller 71 and the pressure roller 72 heated by the heaters, thereby fusing and mixing the toner images to fix the color image onto the recording material as a permanent image. After the fixing operation, the recording material is discharged out of the apparatus.

After the electricity on the transfer drum is removed by outer and inner electricity removal chargers 14, 15 to remove the electrostatic absorbing force, the developer remaining on the transfer drum 8 is scraped by a rotating fur brush 16. The cleaning means for removing the developer from the transfer drum 8 may be a blade or a non-woven fabric web, other than the fur brush. Of course, these elements may be used in combination.

As mentioned above, in the color image forming apparatus having the above-mentioned arrangement, the toner images are transferred onto the same recording material 6 by four times. By the way, in the past, in order to generate the transfer electric field, a high voltage (as a transfer voltage) from a high voltage power source was applied to the transfer charge means under constant current control or constant voltage control. However, for example, in the constant current control, a maximum voltage value (i.e. a maximum output voltage of the high voltage power source) applicable to the transfer charge means was constant for four colors.

Thus, among the plurality of transferring operations, in the transferring operation for the first color (yellow), there arose a problem that excessive transfer electric field is generated at the transfer station. Further, FIG. 8 shows a typical example that the voltage is applied to the transfer charge means 4 under the constant current control. In FIG. 8, a terminal 201 is connected to the transfer charge means 4. In this case, by feeding-back a current detection portion 202 to a primary side of a transformer, a switching power source for effecting the constant current control is obtained (although the present invention is not limited to such a control method, but explanation will be continued with reference to this example).

However, in the above example, since the maximum electric power (maximum voltage under the constant current control, and maximum current under the constant voltage control) to be applied to the transfer charge means is determined without differentiating between the case where an imaging portion (onto which the image can be formed in response to any image information) of the image bearing member is positioned at the transfer station and the case where a non-imaging portion (onto which the image cannot be formed in response to any image information) of the image bearing member is positioned at the transfer station, the excessive charging occurs in local positions of the non-imaging portion (for example, tip end portion of the recording material, rear end portion of the recording material or connection member 8*c* of the cylindrical frame in FIG. 6).

That is to say, when the high voltage power source is turned ON/OFF or when a portion of the frame connection member 8*c* of the transfer drum 8, a portion of the dielectric sheet 8*a* immediately after that portion of the frame connection member (portion of the dielectric sheet 8*a* near an upstream end of the frame connection member 8*c* in a rotating direction of the transfer drum) and a portion of the dielectric sheet 8*a* immediately after the rear end of the born recording material 6 (portion of the dielectric sheet 8*a* near an upstream rear end of the recording material 6 in the rotating direction of the transfer drum) passes through the transfer station, if the high voltage is applied to the transfer charge means 4 under the constant current control, voltage fluctuation will occur, thereby applying excessive voltage, i.e. excessive transfer electric field to the transfer station.

The excessive voltage is a voltage greater than voltage generating the transfer current under the normal transferring operation. As an example, FIG. 7 shows change in output voltage of the high voltage power source when the first to four color toner images are transferred onto the recording material while applying the high voltage from the high voltage power source to the transfer charge means under the constant current control. In this case, the dielectric sheet 8*a* was formed from a PET film including carbon as filler, a transfer charge brush was used as the transfer charge means 4, the maximum output voltage the high voltage power source was 10 kV and the high voltage was applied to the transfer charge means 4 under the constant current control of 10 μA. FIG. 7 will be fully described later.

During the transferring operation, if the abovementioned excessive transfer electric field is locally generated, dielectric breakdown will occur on the applied portion of the dielectric sheet 8*a*, thereby causing "pin hole" or residual charge remains on the photosensitive drum 1 or the dielectric sheet 8*a*, thereby distorting the image.

SUMMARY OF THE INVENTION

An object of the present invention is to provide an image forming apparatus which can prevent dielectric breakdown of an image bearing member to extend a service life of the latter.

Another object of the present invention is to provide an image forming apparatus which can prevent excessive electric power from being applied to a transfer means when a non-imaging portion of an image bearing member is positioned at a transfer station.

A further object of the present invention is to provide an image forming apparatus which can prevent excessive electric power from being applied to a transfer means during first image transferring onto a recording material when a plurality of image transferring operations are effected regarding the same recording material.

A still further object of the present invention is to provide an image forming apparatus which can prevent dielectric breakdown of a recording material bearing member.

The other objects and features of the present invention will be apparent from the following detailed explanation of the invention.

DETAILED DESCRIPTION OF THE PREFERRED EMBODIMENTS

First Embodiment

Figure 1:
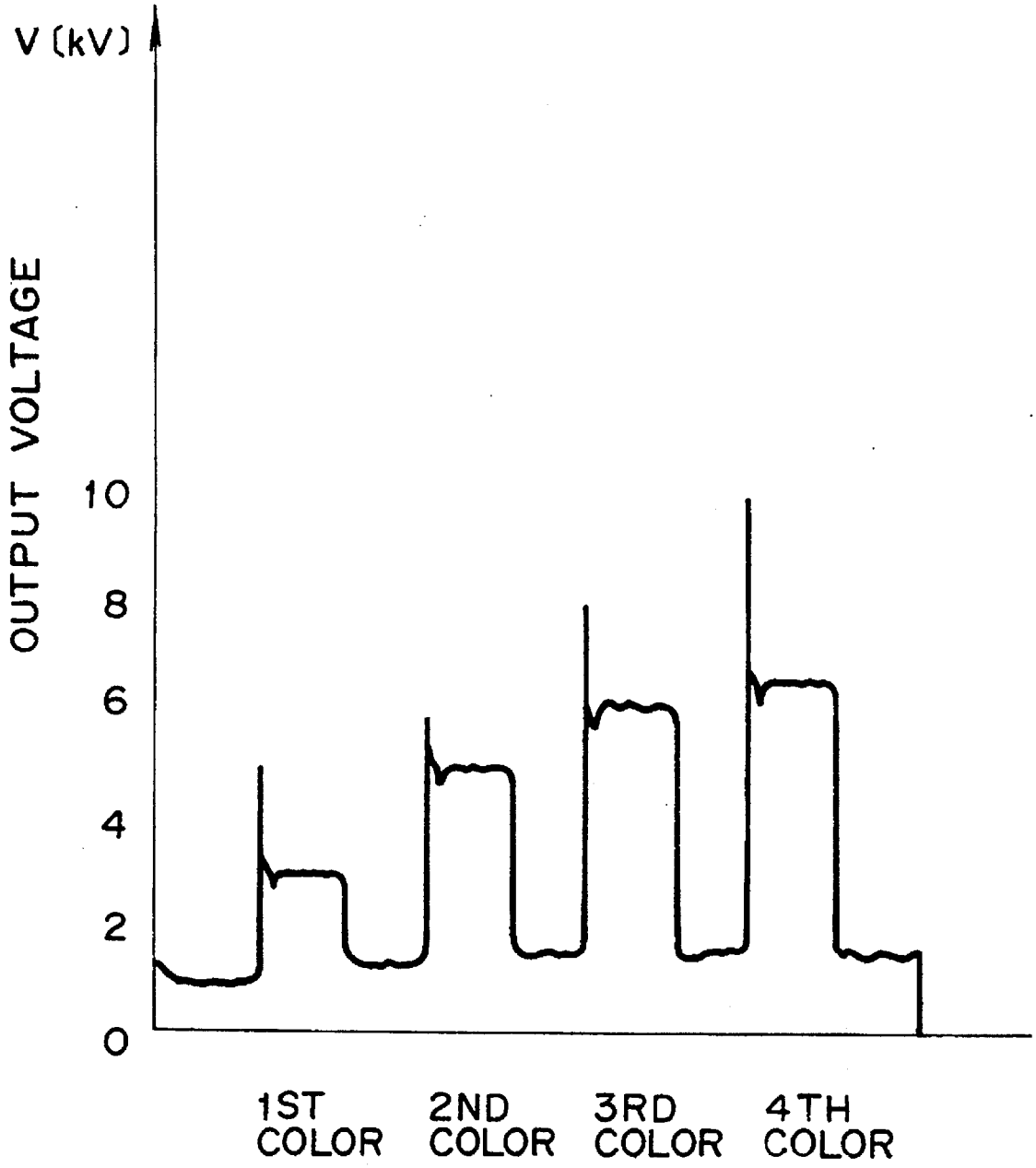
FIG. 1 is a graph showing change in output voltage of a high voltage power source for a transfer charge means in an image forming apparatus according to a preferred embodiment of the present invention.

FIG. 1 is a graph showing change in output voltage of a high voltage power source for a transfer charge means in an image forming apparatus according to a preferred embodiment of the present invention.

The present invention is characterized in that high voltage is applied to a transfer charge means under constant current control so that maximum voltage value (maximum output voltage values of a high voltage power source) are changed for first to fcurth colors, when various color toner images having different colors and formed on an image bearing member are successively transferred onto a recording material in a superimposed fashion by generating a transfer electric field at a transfer station by applying the high voltage (as transfer voltage) to the transfer charge means and by applying the transfer electric field to the transfer station.

Figure 5:
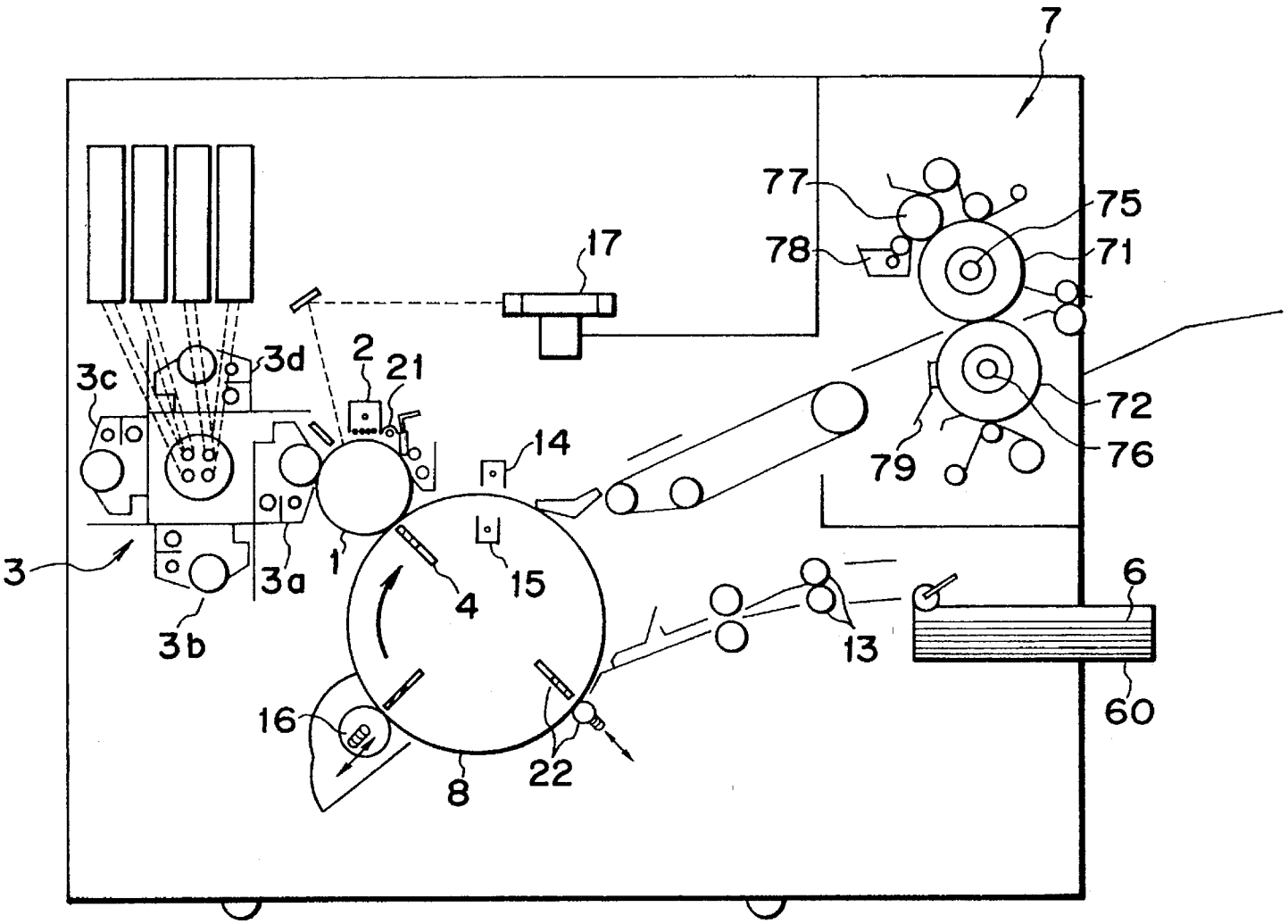
FIG. 5 is a sectional view of a conventional image forming apparatus.
Figure 6:
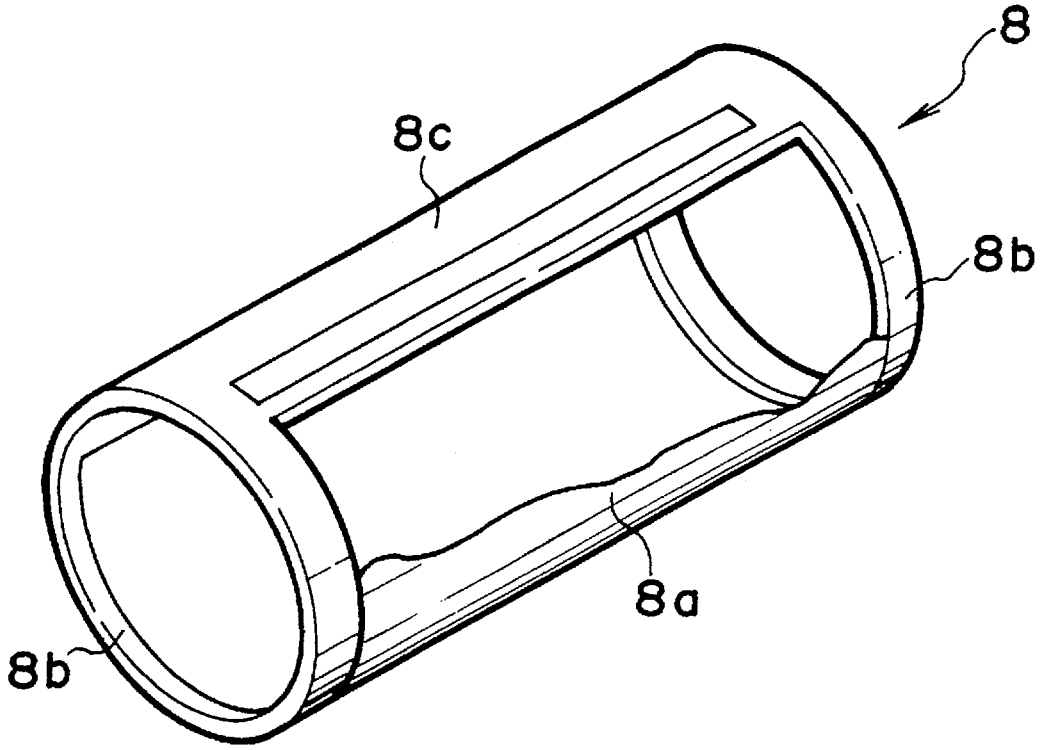
FIG. 6 is a perspective view of a transfer drum of the image forming apparatus of FIG. 5.

Since the construction and .function of the image forming apparatus itself according to the first embodiment of the present invention is substantially the same as those of the conventional image forming apparatus already explained with reference to FIGS. 5 and 6, illustration of the image forming apparatus itself will be omitted, and the apparatus will be explained with reference to FIGS. 5 and 6.

Figure 7:
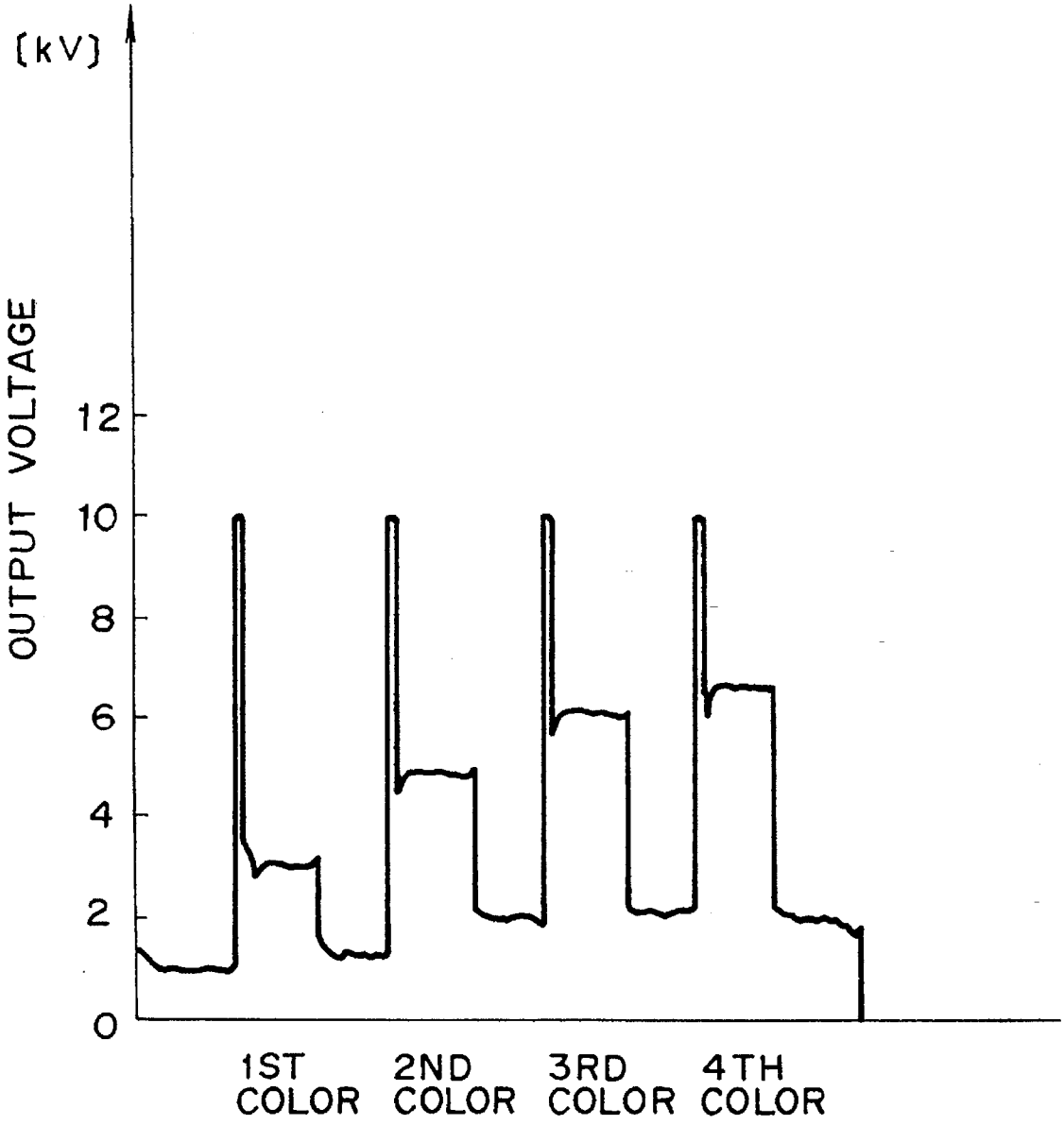
FIG. 7 is a graph showing change in output voltage of a high voltage power source for a transfer charge means in the image forming apparatus of FIG. 5.

First of all, when high voltage for generating a transfer electric field is applied to a transfer charge means 4 contacted with an inner surface of a transfer drum 8 under constant current control referring to FIG. 7, as a frame connection member 8*c* of the transfer drum 8 shown in FIG. 6 passes through the transfer charge means 4 (transfer station), since the voltage applied being applied to the transfer charge means 4 is fluctuated, i.e. current does not flow from the transfer charge means 4 to a photosensitive drum 1, the voltage supplied from a high voltage source is increased, with the result that the maximum output voltage of 10 kV is applied to the transfer charge means as it is. Accordingly, the excessive transfer electric field having potential difference of 10 kV is generated at the transfer station. The excessive transfer electric field is temporarily applied to a portion of a dielectric sheet 8*a* immediately behind of the frame connection member 8*c* (upstream portion of the dielectric sheet 8*a* in a rotating direction of the transfer drum) locally when that portion passes through the transfer station.

As a result, the residual charge is locally generated on the photosensitive drum 1. Since toner is apt to be adhered to the charged portion of the drum due to the residual charge, when the development is effected with respect to the photosensitive drum in the next color toner image formation, the portion of the drum charged by the residual charge will be developed more dense than the other portion. Consequently, when the first to fourth color toner images are transferred onto the recording material, a dense portion is generated on the image along a longitudinal direction of the photosensitive drum, thereby causing the poor image. Further, if the excessive transfer electric field is applied, the local dielectric breakdown is caused on the dielectric sheet (recording material bearing member) 8*a*, and such dielectric breakdown causes the poor image.

To avoid this, for example, the recording material is born on the transfer drum in a spaced relation to the frame connection member 8*c* to separate a tip end of the toner image transferred to the recording material from the frame connection member 8*c*, and the high voltage power source is turned OFF or the transfer charge means 4 is separated from the transfer drum 8 not to apply the voltage to the frame connection member 8*c*. However, by do so, the transfer drum 8 becomes bulky or high speed image formation is obstructed or a complex mechanism for separating the transfer charge means must be added. Thus, such solution is not practical.

Further, when the high voltage is applied to the transfer charge means 4 under the constant current control, the apply voltage (output voltage of the high voltage power source) is influenced upon material existing between the transfer charge means 4 and the photosensitive drum 1 (transfer nip). That is to say, in FIG. 5, in an initial condition, before the transferring operation for the first color toner image, only the non-charged dielectric sheet 8*a* exists in the transfer nip. Thus, as shown in FIG. 7, the apply voltage is about 1 kV. When the transfer drum 8 is rotated to bring the frame connection member 8*c* to the transfer nip, since the current does not flow, the apply voltage is increased to about 10 kV. Thereafter, when the frame connection member leaves the transfer nip to leave the dielectric sheet 8*a* alone in the transfer nip, although the apply voltage is decreased, since the recording material 6 born on the dielectric sheet 8*a* and the transferred first color toner image on the photosensitive drum 1 reach the transfer nip, the apply voltage is increased to about 3 kV, and, thus the first color toner image is transferred onto the recording material with voltage of about 3 kV. That is to say, in the transferring operation for the first color toner image, the apply voltage of about 3 kV is required. In this case, it was found that the apply voltage of the imaged portion of the recording sheet is greater than the apply voltage of the non-image portion of the recording material by about 200 V.

Thereafter, since only the portion of the dielectric sheet 8*a* which does not bear the recording material 6 reaches the transfer nip, the apply voltage is decreased. Then, when the transfer drum 8 starts the second revolution to transfer the second color toner image, the apply voltage becomes about 4.8 kV.

Figure 2:
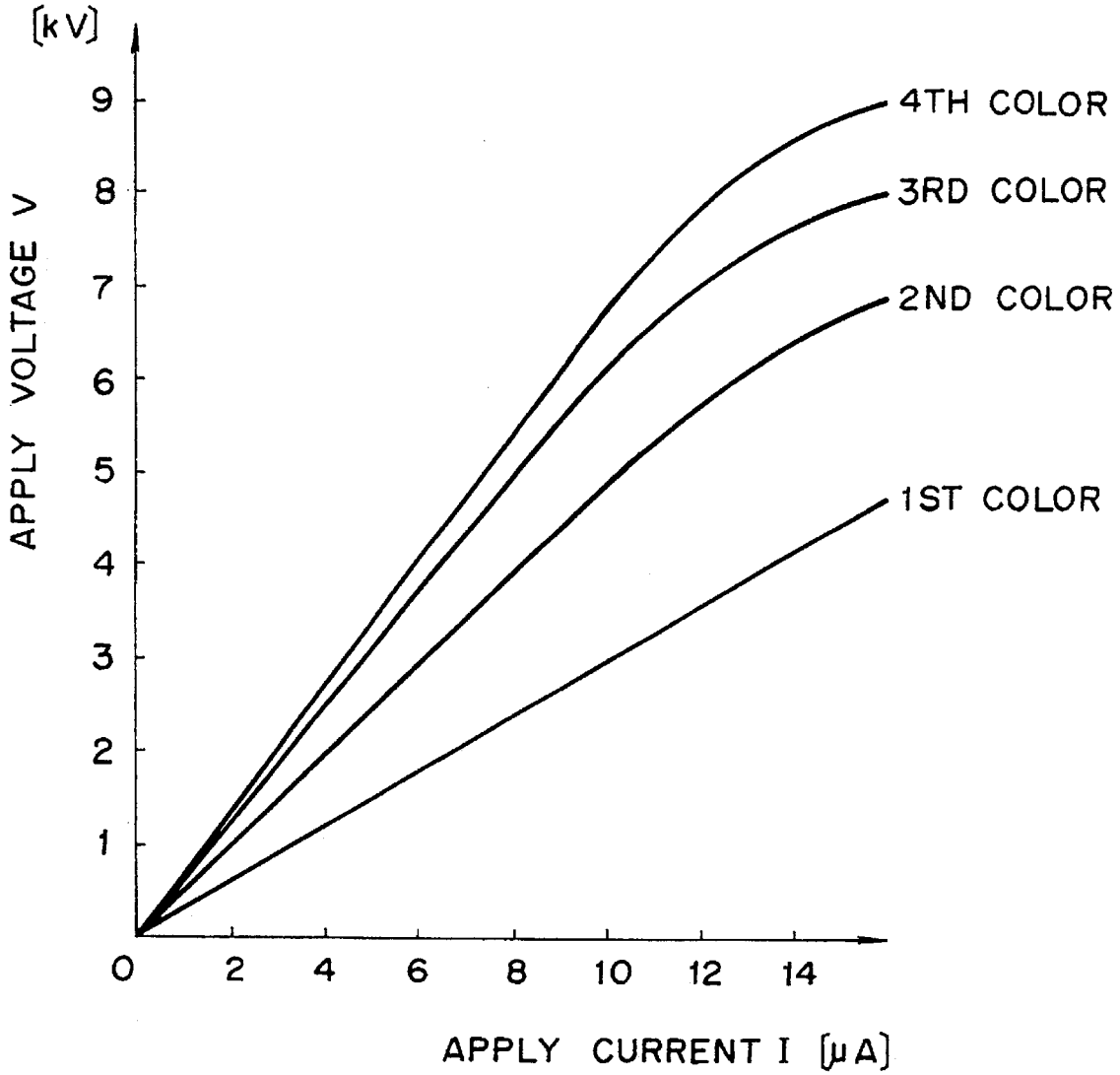
FIG. 2 is a graph showing a relation between current and voltage of the high voltage power source of FIG. 1.

In this way, when the toner images are transferred onto the recording material, on the basis of a relation between the apply voltage (V) and apply current (I) shown in FIG. 2, the apply voltage is gradually increased from the first color to the fourth color in the case where the constant current control is effected with respect to the transfer charge means. Therefore, ideally, the apply voltage for the fourth color may be the maximum output. However, in the I-V feature as shown in FIG. 2, the required apply voltage is considerably changed in accordance with electric resistance of the recording material 6 and/or humidity of the recording material and/or material thereof.

In order to provide an image forming apparatus which can handle various kinds of recording materials as much as possible and which can be used under various circumstances, as shown in FIG. 7, it is required that the maximum output voltage values for the respective colors are set to be greater, respectively.

When the maximum output voltage is applied in the transferring operation, if the recording material 6 and/or the toner image exist at the transfer station, the voltage applied to the recording material bearing sheet (dielectric sheet) is voltage-divided to the recording material and toner; whereas, if there is no recording material and toner at the transfer station, since the voltage is directly applied to the dielectric sheet, the dielectric breakdown is apt to occur in the dielectric sheet. Further, when the frame connection member 8*c* of the transfer drum exists at the transfer station, since the imaged area reaches the transfer station, the transferred image is influenced upon the voltage. However, regarding the rear end of the image, it is possible to prevent the high voltage from being applied to the image (i.e. influencing upon the image) by turning OFF the high voltage power source early, for instance. Further, when a plurality of transferring operations are successively effected, since the I-V feature of the transfer means shown in FIG. 2 indicates the fact that the voltage is gradually increased from the first color to the last color, in case of FIG. 5, only the fourth color requires the maximum output voltage.

Thus, in the illustrated embodiment, as shown in FIG. 1, the maximum output voltage values applied to the imaged portions were 5 kV (for first color), 6 kV (for second color), 8 kV (for third color) and 10 kV (for fourth color), respectively, and the voltage was applied under the constant current control of 10 μA. As a result, it was found that the service life of the dielectric sheet 8 is extended.

By setting the limit values (maximum output apply voltage values) at the image forming portion in this way, it is possible to suppress the excessive electric field during the transferring of the images.

Figure 10:
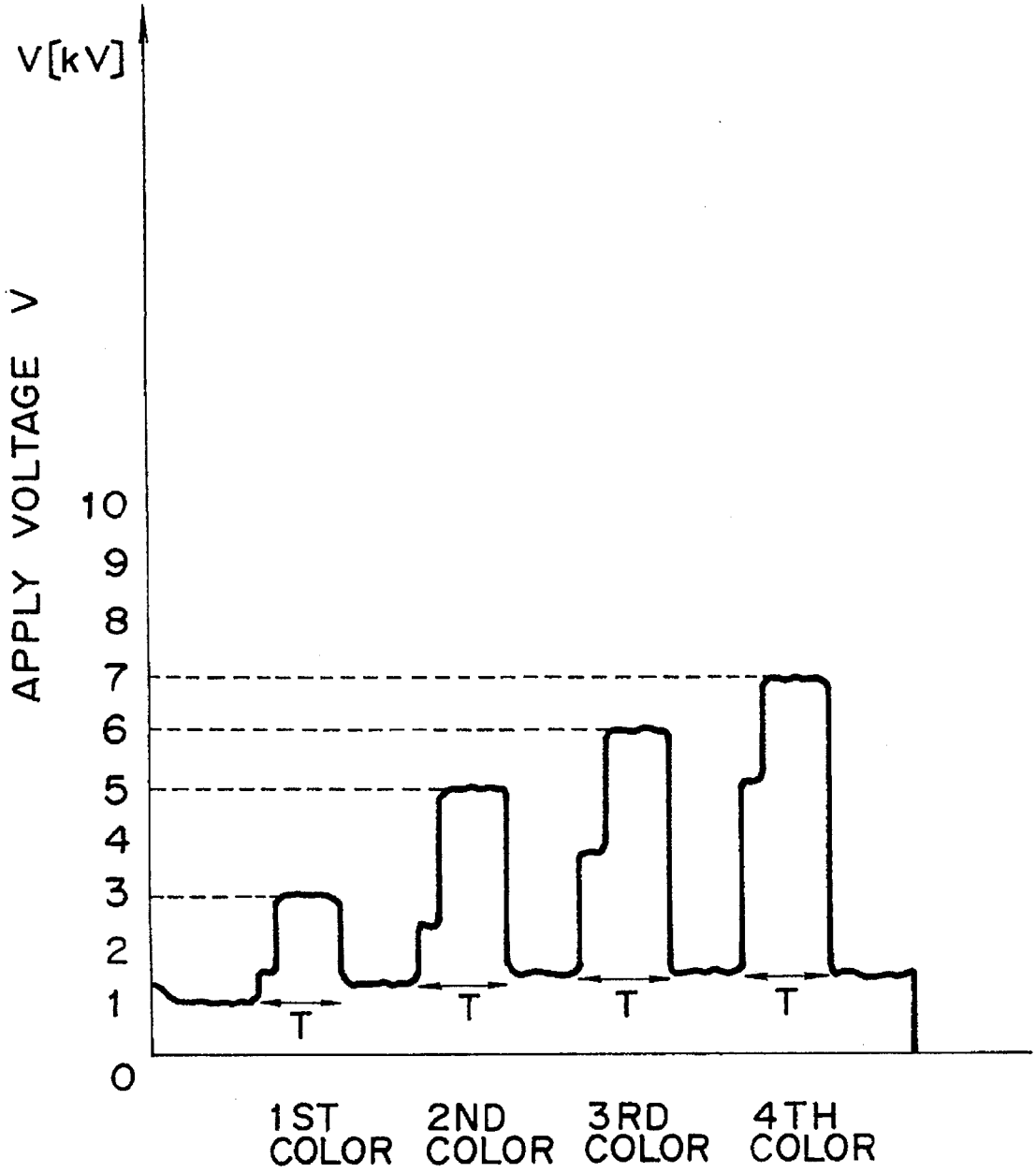
FIG. 10 is a graph showing change in output voltage of a high voltage power source for a transfer charge means in the image forming apparatus according to the present invention.

In order to suppress the excessive electric field immediately after the frame connection member leaves the transfer station, as shown in FIG. 10 (wherein T indicates time durations during which the recording material passes through the transfer station), it is desirable that the maximum output apply voltage values of the transfer means are set to be ½ of the imaged portions, i.e. 1.5 kV (for first color), 2.5 kV (for second color), 4 kV (for third color) and 5 kV (for fourth color), respectively, until a tip end portion of 2 mm (of the recording material 6) passes through the transfer station.

In this way, since the maximum output apply voltage values of the transfer means are set to be ½ of the imaged portions only till the tip end portion of 2 mm (of the recording material 6) passes through the transfer station, in the illustrated embodiment, the imaged portion following to the front margin of 5 mm (of the recording material) is not influenced by the high voltage. In this way, the influence of the excessive electric field can be prevented. When the maximum output apply voltage (1.5 kV for first color) is set lower than the imaginary apply voltage (3.0 kV for first color as shown in FIG. 10) regarding the tip end of the imaged portion in this way, in the illustrated embodiment, the set constant current of 10 μA does not flow to the transfer means, but only the current of about 5 μA (about ½ of the set value) flows to the transfer means. That is to say, regarding the non-imaged portion, the constant voltage control (1.5 kV for first color) is substantially effected, and the imaged portion is subjected to the constant current control of 10 μA. According to the illustrated embodiment, by merely delaying the output timing of the transfer high voltage, it is possible to suppress the spark current when the high voltage power source is turned ON and to hasten the rising time. In particular, since the control voltages for the non-imaged portion are set for the respective colors, it is possible to stabilize the rising feature for each color.

Figure 8:
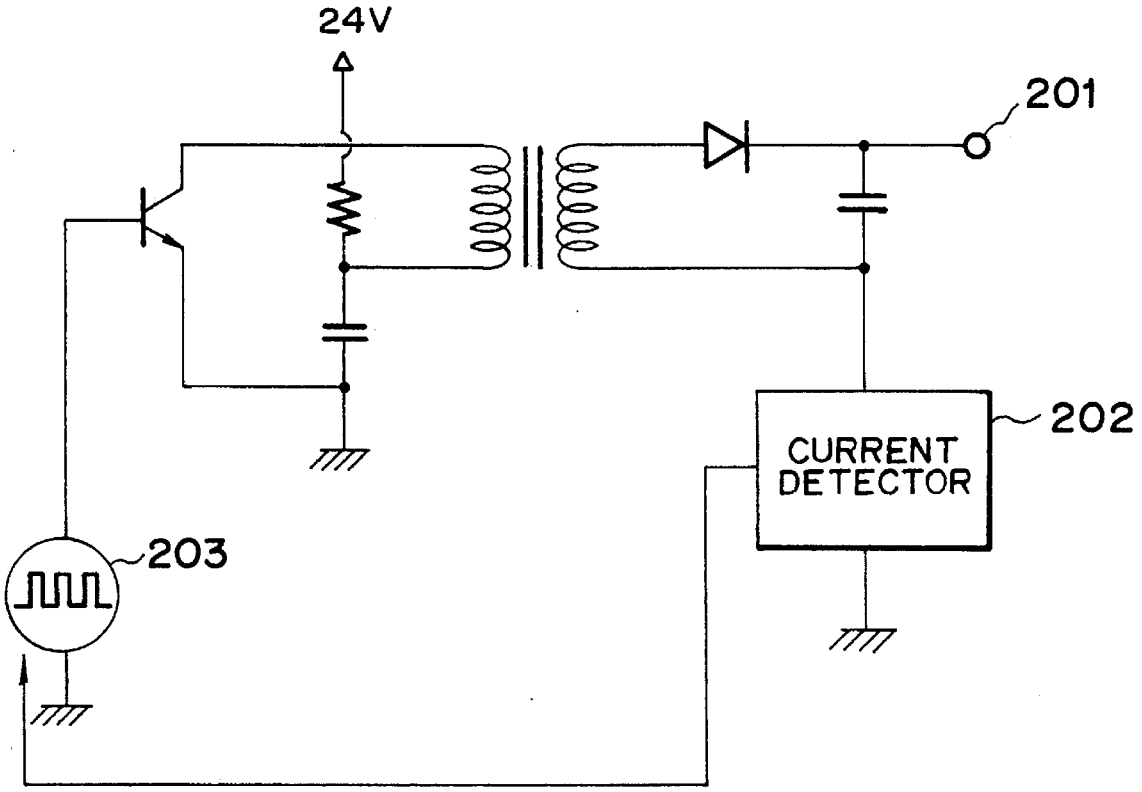
FIG. 8 is a view showing a circuit of the high voltage power source for the conventional transfer charge means.
Figure 9:
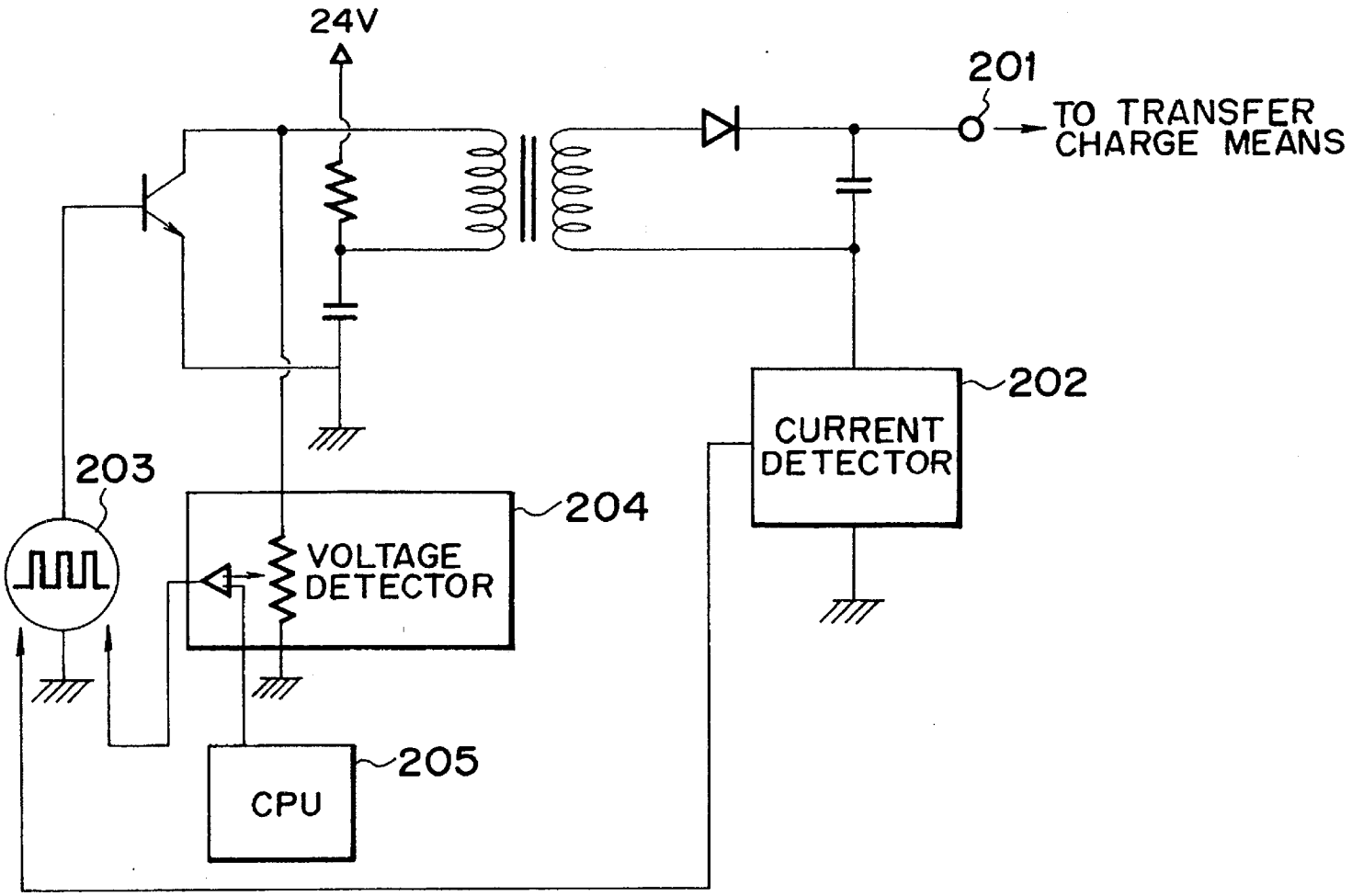
FIG. 9 is a view showing a circuit of the high voltage power source for the transfer charge means of the image forming apparatus according to the present invention.

Next, the control method effective to the illustrated embodiment will be explained in connection with the already explained conventional technique shown in FIG. 8. FIG. 9 shows an example that the present invention is applied to the constant current control method shown in FIG. 8. Different from FIG. 8, in the example shown in FIG. 9, a voltage detector 204 is arranged at a primary side of a transformer, and a value detected by the voltage detector 204 is compared with a set value in a CPU 205, thereby feeding-back a compared result to a pulse generator 203. By using the voltage detector 204, the apparatus is controlled so that the voltages of 1.5 kV (for first color), 2.5 kV (for second color), 4 kV (for third color) and 5 kV (for fourth color) are detected when a tip end portion of 2 mm (of the recording material) passes through the transfer station. However, as mentioned above, this example an only an example, and, thus, the voltage detector 204 may be connected to a secondary side of the transformer.

Second Embodiment

Figure 3:
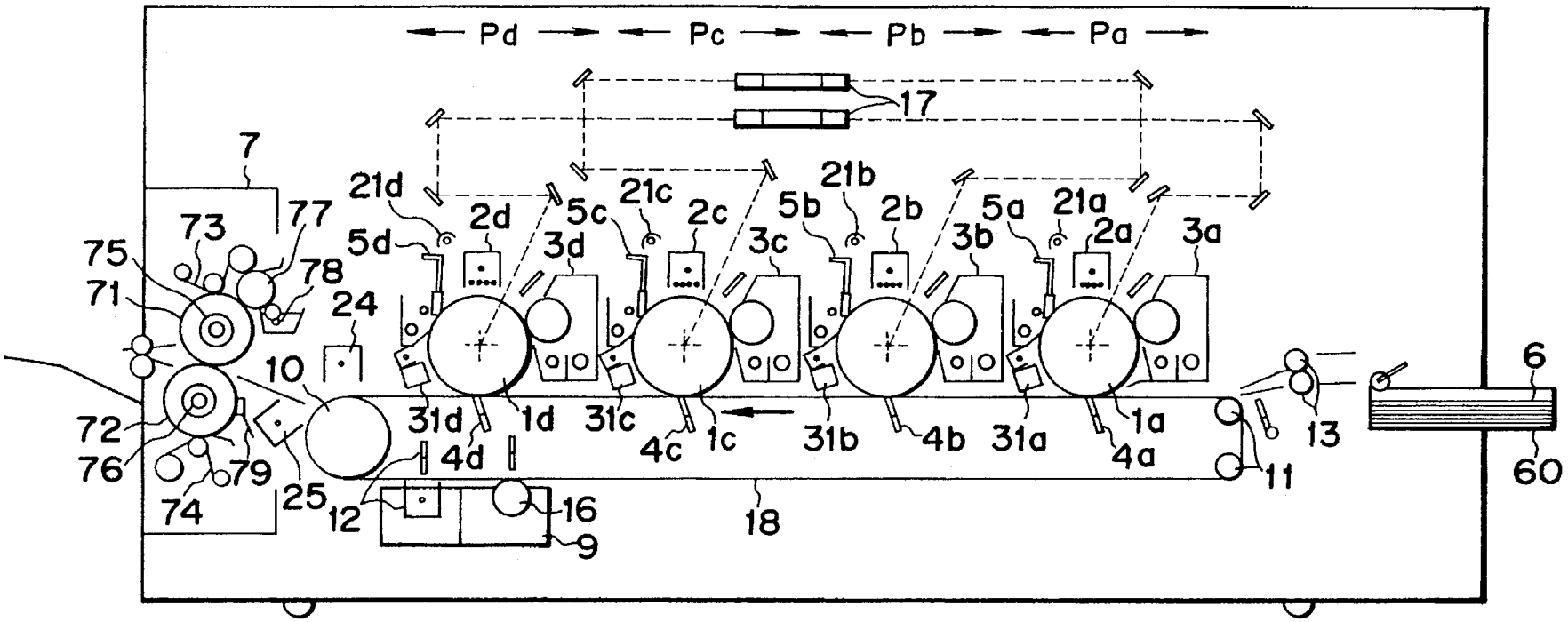
FIG. 3 is a sectional view of an image forming apparatus according to another embodiment of the present invention.

A second embodiment of the present invention relates to a color image forming apparatus having a plurality of image bearing members and a plurality of transfer means. An example of such an electrophotographic color copying machine is shown in FIG. 3.

In this embodiment, the electrophotographic color copying machine includes first to fourth image forming portions Pa, Pb, Pc and Pd arranged side by side and having photosensitive drums 1*a*, 1*b*, 1*c* and 1*d*, respectively. Various toner images having different colors are formed on the photosensitive drums 1*a*–1*d* through latent image formation and development. Below the image forming portions Pa–Pd, there is arranged a convey belt (recording material bearing member) 18 wound around a drive roller 10 and a driven rollers 11 so that the toner images formed on the photosensitive drums 1*a*–1*d* can be transferred onto the recording material supported by the convey belt 18.

Around the photosensitive drums 1*a*, 1*b*, 1*c* and 1*d*, there are arranged exposure lamps 21*a*, 21*b*, 21*c* and 21*d*, first chargers 2*a*, 2*b*, 2*c* and 2*d*, developing devices 3*a*, 3*b*, 3*c* and 3*d*, photo-sensors 31*a*, 31*b*, 31*c* and 31*d* and drum cleaners 5*a*, 5*b*, 5*c* and 5*d*, respectively. Further, transfer charge means 4*a*, 4*b*, 4*c* and 4*d* comprising transfer charge brushes contacting with an inner surface of the convey belt 18 are arranged below the photosensitive drum 1*a*, 1*b*, 1*c* and 1*d*.

At upper parts of the image forming portions Pa–Pd, a light source (not shown) and polygon mirrors 17 are arranged above the photosensitive drums 1*a*–1*d* so that laser light emitted from the light source is scanned by rotating the polygon mirrors 17 and is deflected by reflection mirrors to be focused on the generatrices of the photosensitive drums 1*a*–1*d* through fθ lenses, thereby exposing the photosensitive drums. Consequently, latent images for various colors are formed on the photosensitive drums 1*a*–1*d* in response to image signals.

The latent images formed on the photosensitive drums 1*a*–1*d* are developed by the developing devices 3*a*–3*d* as visualized toner images. Yellow color developer, magenta color developer, cyan color developer and black color developer are supplied from respective supply sources to the developing devices 3*a*–3*d* by a predetermined amount, respectively.

The recording material 6 onto which the toner images are to be transferred is sent from a recording material cassette 60 to the convey belt 18 via a sheet supply roller, a pair of resist rollers 13 and a sheet supply guide and then is born on the convey belt. The convey belt 18 may be formed from a film made of polyethylene terephthalate (PET) resin, polyvinylidene fluoride resin or polyurethane resin, and is formed in an endless shape by overlapping and securing both ends of the film.

When the convey belt 18 starts to rotate, the recording material 6 is supplied onto the convey belt 18 from the pair of regist rollers 13. In this case, an image writing start signal is turned ON, and the image formation regarding the photosensitive drum 1*a* of the first image forming portion Pa is started at a certain timing. The yellow toner image formed on the photosensitive drum 1*a* by the image formation is transferred onto the recording material 6 conveyed by the convey belt 18 by applying an electric field or charge to the transfer station. The recording material 6 is held on the convey belt 18 by the electrostatic absorbing force during the transferring operation and is sent to the second image forming portion Pb.

In the second image forming portion Pb, similar to the first image forming portion, the magenta toner color image is formed on the photosensitive drum 1*b* and then is transferred onto the recording material 6 conveyed by the convey belt 18 in a superimposed relation to the yellow toner image. Similarly, in the third and fourth image forming portions Pc and Pd, the cyan color image and black color image are formed on the photosensitive drum 1*c* and 1*d*, respectively, and these toner images are transferred onto the recording material 6 in a superimposed relation to the transferred toner images. In this way, the yellow, magenta, cyan and black toner images are superimposed on the recording material 6, thereby obtaining a color image.

The recording material 6 to which the four color toner images were transferred is separated from the convey belt 18 by removing electricity from the convey belt 18 by means of a separation charger 24 and a peel charger 25 in the proximity of a roller 10 at the left end of the convey belt 18, and then is sent to a fixing device 7.

The recording material 6 sent to the fixing device 7 is heated and pressurized between a fixing roller 71 and a pressure roller 72 which are heated by heaters 75 and 76, thereby fusing and mixing the toner images to fix the toner as a permanent full-color image. Thereafter, the recording material is discharged out of the image forming apparatus. Mold releasing oil reserved in an oil reservoir 78 is coated on an outer peripheral surface of the fixing roller 71 via a coating roller 77, and a thermistor 79 for controlling a fixing temperature is contacted with an outer peripheral surface of the pressure roller 72. Further, the fixing roller 71 and the pressure roller 72 are cleaned by heat-resistive cleaning members 73 and 74.

After the transferring operation, the residual developers remaining on the photosensitive drums 1*a*, 1*b*, 1*c* and 1*d* are removed by the cleaners 5*a*, 5*b*, 5*c* and 5*d* for preparation for next image formation. After the electricity on the convey belt 18 is removed by a belt electricity removal device 12 to remove the electrostatic absorbing force, tht developer remaining on the convey belt 18 is scraped by a rotating fur brush 16. The cleaning means for cleaning the convey belt 18 may be a blade or a non-woven fabric web, other than the fur brush. Of course, these elements may be used in combination.

As is in the illustrated embodiment, in an image forming apparatus having four photosensitive drums 1*a*–1*d*, four transfer charge means 4*a*–4*d* are required, and, accordingly, four high voltage power sources are required for applying transfer high voltages to the transfer charge means 4*a*–4*d*. In the illustrated embodiment, the transfer charge means 4*a*–4*d* are operated under constant current control.

In the illustrated embodiment, the high voltage power sources having maximum output voltages of 5 kV, 6 kV, 8 kV and 10 kV are used for the transfer chargers 4*a* (for first color), 4*b* (for second color), 4*c* (for third color) and 4*d* (for fourth color), respectively. By using the high voltage power sources having different maximum output voltages in this way, in comparison with the case where the high voltage power source for fourth color having the greatest maximum output voltage is also used for first to third color, the cost of the high voltage power sources can be reduced greatly.

Also in this embodiment, it is possible to prevent the excessive transfer electric field in the first to third transferring operations, thereby transferring all of the first to fourth color toner images well and to prevent the pin hole from generating on the convey belt made of dielectric resin film, thereby extending the service life of the convey belt.

In the above-mentioned embodiments, while the maximum output voltages of the high voltage power sources were changed to be gradually reduced from the fourth color to the first color, for example, the maximum output voltages for the first and second colors may be 5 kV and the maximum output voltages for the third and fourth colors may be 10 kV. That is to say, the maximum output voltages are so set that the maximum output voltage for a certain stage color is not smaller than the maximum output voltage for a next higher stage color.

Further, in such an image forming apparatus, since toner is used as color element, and the latent image formation, development and transferring are effected in accordance with the charged amount of toner, the image forming condition is considerably changed depending upon environment where the image forming apparatus is installed and/or a wetting condition of the recording material. For example, in the above-mentioned image forming apparatus, even if the transfer apply voltages of 3 kV, 5 kV, 6 kV and 7 kV are optimum under a condition having a temperature of 25° C. and humidity of 60% RH, these transfer apply voltages will be excessive under a condition having a temperature of 30° C. and humidity of 85% RH, because the charged amount of the toner is decreased as the humidity is increased, with the result that the set value of the optimum transfer current is decreased and the impedance is also decreased due to the increase in the humidity of the recording material and the recording material bearing member, thereby reducing the apply voltage during the transferring operation.

To avoid this, it is more effective that the environment where the image forming apparatus is installed is detected by a temperature and humidity sensor so that the limit voltage values for the imaged portions are set to 1 kV, 2.5 kV, 4 kV, 5 kV, respectively.

Incidentally, the environment detection is not limited to use of the humidity sensor or temperature and humidity sensor, but an operator or a service man change the set values by detecting the environment by means of an external sensor and the like. Further, in the aforementioned embodiments, while the imaged portion was referred to, also in this example, as is in the former example, by setting the limit value of the non-imaged portion smaller than that of the imaged portion, it is possible to prevent the poor image caused due to drum ghost and the like and to suppress the dielectric breakdown of the recording material bearing member. In this case, similar to the former example, when the limit values of the non-imaged portion are reduced by −2 kV, for instance, in comparison with the limit values of the imaged portion, respectively, without reducing the limit values of the non-imaged portion to 50% of the limit values of the imaged portion, a table for controlling the environment can easily be formed.

Third Embodiment

In general, the value of the transfer electric field is increased as a thickness of the recording material (paper thickness) is increased or when images are formed on both surfaces of the recording material. In such a case, in place of the fact that the maximum output voltages of the high voltage power sources are set to eliminate the above problem, when the control is effected so that the maximum output voltages becomes greater than those in the normal image formation when thick recording material is used or when the images are formed on both surfaces of the recording material, the excessive transfer electric field can effectively be prevented.

In the image forming apparatus according to the second embodiment explained with reference to FIG. 3, the maximum output voltages of the high voltage power sources for the transfer charge means 4*a*, 4*b*, 4*c* and 4*d* for, first, second, third and fourth colors, respectively, are set to 5 kV, 6 kV, 8 kV and 10 kV, respectively, and the toner images are transferred onto the recording material under the constant current control of 10 μA. In this case, a normal electrophotographic paper sheet having a weight of 64–105 g/m$^2$ is suitable as the recording material.

In this embodiment, when the images are formed on both surfaces of the recording material having a weight of 64–105 g/m$^2$ or when the image is formed on one surface of a recording material having a heavier weight, the maximum output voltages of the high voltage power sources for the transfer charge means 4*a*, 4*b*, 4*c* and 4*d* for, first, second, third and fourth colors, respectively, are set to 5 kV, 6 kV, 8 kV and 10 kV, respectively, and the toner images are transferred onto the recording material under the constant current control.

The recognition of use of thick recording material and both-face image formation can be effected by using selection buttons, and, when the images are formed on both surfaces of the recording material, the recording material is reversely rotated by an automatic reverse rotation sheet supply apparatus after the image was formed on one surface of the recording material. In the illustrated embodiment, after the recognition is effected, when the maximum output voltages are set as mentioned above, the good transferring operations can be achieved and the good quality image can be obtained.

Fourth Embodiment

Figure 4:
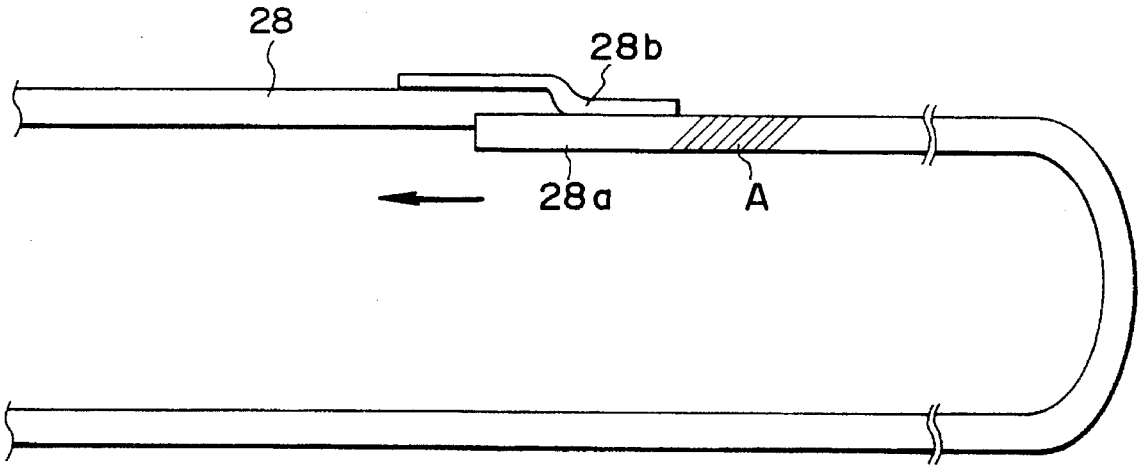
FIG. 4 is a sectional view of a convey belt of an image forming apparatus according to a further embodiment of the present invention.

According to a fourth embodiment of the present invention, in the image forming apparatus shown in FIG. 3, in place of the convey belt 18, as shown in FIG. 4, a convey belt 28 having a seam 28*a* is used. The convey belt 28 is a conventional one and is formed from a PET film including carbon as filler, and the seam 28*a* is securely connected by heat fusion. Since the seam 28*a* has a greater thickness but has less strength, the seam is reinforced by a Myler tape 28*b* having a thickness of 50 mm.

The electric resistance of the seam 28 of the convey belt 28 often differs from the electric resistance of the other portion of the convey belt. Thus, when the high voltages are applied from the high voltage power sources to the transfer charge means in order to transfer the toner images onto the recording material supported by the rotating convey belt 28, since the change in resistance is great when the seam 28 passes through the transfer stations, the dielectric breakdown occurs at a portion A of the convey belt immediately behind of the seam 28 and memory is generated due to the residual charge, thereby distorting the image. Such phenomenon is particularly apt to occur when the high speed and continuous image formation is effected by using the image forming apparatus shown in FIG. 3 since it is difficult to prevent the high voltage from being repeatedly applied to the seam 28*a* due to the fact that the transfer high voltage is turned ON/OFF between the plural recording materials born on the convey belt 28.

Also in this embodiment, since the maximum output voltages of the high voltage power sources for the transfer charge means 4*a*, 4*b*, 4*c* and 4*d* for, first, second, third and fourth colors, respectively, are set to 5 kV, 6 kV, 8 kV and 10 kV, respectively, to be gradually reduced from the fourth color to the first color, it is possible to prevent the high voltage from being repeatedly applied to the seam 28*a* of the convey belt 28 and to prevent the excessive transfer electric field from generating in the first and third transferring operations, thereby well transferring the first through fourth color toner images onto the recording material. Further, it is possible to prevent the pin hole from generating on the convey belt 28, thereby extending the service life of the convey belt.

In this case, as is in the aforementioned example, although the apply voltages regarding the imaged portions are set to be 5 kV, 6 kV, 8 kV and 10 kV, respectively, with respect to the non-imaged portions, even when the limit values are not set to be gradually increased whenever the non-imaged portions pass through the transfer stations (for example, the limit values are set to 1 kV for all of four colors), the excellent result can be obtained.

In the above-mentioned embodiments, while examples that the voltages are applied to the transfer charge means under the constant current control, the present invention is not limited to such examples. For instance, in the image forming apparatus shown in FIG. 3, when the voltages of 3 kV (for first color), 5 kV (for second color), 6 kV (for third color) and 7 kV (for fourth color) are applied to the transfer charge means under the constant voltage control, only the current of about 10 μA flows in the imaged portions; whereas, the current of about 25 μA flows in the non-imaged portion between the recording materials. Thus, as mentioned above, various drawbacks such as the dielectric breakdown (on the recording material bearing member and/or photosensitive drum), electric memory and the like will occur.

Further, as is in the illustrated apparatus, when the high speed operation is effected and a distance between the recording materials is short, if the ON/OFF operation of the high voltage power source is delayed or if the voltage applied to the non-imaged portion (between the recording materials) cannot be turned OFF due to the spike current, it is effective to provide a current limiter between the recording materials. In this case, when the value of the current limiter is set to be equal to the current value flowing in the imaged portion as much as possible, it is possible to prevent the unevenness of the residual charge on the recording material supported by the recording material bearing member due to the uniform charging and to also prevent the unevenness of the residual charge on the recording material born on the recording material bearing member after the latter is rotated by one revolution, thereby avoiding the poor image.

As mentioned above, according to the present invention, when the recording material born on the dielectric recording material bearing member is conveyed to the transfer station where the recording material bearing member is opposed to the image bearing member and the toner images having different colors are successively transferred onto the recording material in a superimposed fashion by generating the transfer electric field at the transfer station by applying the high voltage to the transfer charge means and by applying the transfer electric field to the transfer station, since the high voltage is applied to the transfer charge means under the constant current control and the maximum applicable voltages are gradually reduced from the last color to the first color, it is possible to prevent the excessive transfer electric field in the transferring operations for the first to third color toner images, thereby well transferring the first through fourth color toner images, and to prevent the dielectric breakdown on the recording material bearing member and the image bearing member, thereby extending the service lives of these members.

The present invention is not limited to the above-mentioned embodiments, and various alterations and modifications can be effected within the scope of the present invention.

What is claimed is:

1. An image forming apparatus comprising:

an image bearing member for bearing an image thereon; and transfer means for transferring the image from said image bearing member to a recording material at a transfer station, said transfer means performing a plurality of image transferring operations for a common recording material;

wherein a limit value of electric power supplied to said transfer means is changed between a case where an imaged portion of said image bearing member is positioned at said transfer station and a case where a non-imaged portion of said image bearing member is positioned at said transfer station, and wherein the limit value for said imaged portion and said non-imaged portion is set so that the limit value in a last image transferring operation is greater than the limit value in a first image transferring operation, and the limit value in a certain transferring operation does not become larger than the limit value in a next transferring operation.

2. An image forming apparatus according to claim 1, wherein said limit value regarding said imaged portion is equal to maximum voltage applied to said transfer means when said transfer means is controlled under constant current.

3. An image forming apparatus according to claim 1, further comprising a recording material bearing means for bearing the recording material, wherein the image is transferred from said image bearing member to the recording material born on said recording material bearing means at said transfer station.

4. An image forming apparatus according to claim 3, wherein said recording material bearing means comprises a recording material bearing sheet for bearing the recording material, and a support supporting said recording material bearing sheet and extending in a direction perpendicular to a shifting direction of said recording material bearing means.

5. An image forming apparatus according to claim 3, wherein said transfer means can be contacted with an inner side of said recording material bearing means.

6. An image forming apparatus according to claim 1, wherein said limit value of said non-imaged portion is set to be smaller than that of said image portion.

7. An image forming apparatus according to claim 1, wherein said limit value of at least one of said imaged and non-imaged portions is controlled in accordance with an environmental condition.

8. An image forming apparatus according to claim 1, wherein the image forming apparatus can form a full-color image on the recording material.

9. An image forming apparatus comprising:

an image bearing member for bearing an image thereon; and transfer means for transferring the image from said image bearing member to a recording material at a transfer station, said transfer means performing a plurality of image transferring operations for a common recording material;

wherein an amount of current applied to said transfer means is controlled under a constant current, and a maximum voltage value applied to said transfer means is set for every image transferring operation corresponding to the number of the image transferring operations.

10. An image forming apparatus according to claim 9, wherein when a voltage smaller than the maximum voltage value is applied to said transfer means, the amount of current applied to said transfer means is controlled under the constant current.

11. An image forming apparatus according to claim 9, wherein said maximum voltage value is set so that the maximum voltage value in a last image transfer operation among said plurality of image transferring operations is greater than the maximum voltage value in a first image transferring operation and the maximum voltage value in a certain transferring operation does not become smaller than the maximum voltage value in a next transferring operation.

12. An image forming apparatus according to claim 9 or 11, further comprising a recording material bearing means for bearing the recording material, wherein the image is transferred from said image bearing member to the recording material born on said recording material bearing means at said transfer station.

13. An image forming apparatus according to claim 12, wherein said recording material bearing means comprises a recording material bearing sheet for bearing the recording material, and a support supporting said recording material-bearing sheet and extending in a direction perpendicular to a shifting direction of said recording material bearing means.

14. An image forming apparatus according to claim 9, wherein said maximum voltage value is controlled in accordance with an environmental condition.

15. An image forming apparatus according to claim 9, wherein said transfer means can be contacted with an inner side of said recording material bearing means.

16. An image forming apparatus according to claim 9, wherein the image forming apparatus can form a full-color image on the recording material.

17. An image forming apparatus comprising:

an image bearing member for bearing an image thereon; and transfer means for transferring the image from said image bearing member to a recording material at a transfer station;

wherein an amount of current applied to said transfer means is controlled under a constant current, and a maximum voltage value applicable to said transfer means is set smaller when a non-imaged portion of said image bearing member is in the transfer position than when an imaged portion of said image bearing member is in the transfer position.

18. An image forming apparatus according to claim 17, wherein the amount of current applied to said transfer means is controlled under the constant current when the voltage smaller than the maximum voltage is applied to said transfer means.

19. An image forming apparatus according to claim 17, wherein said transfer means performs a plurality of image transferring operations for a common recording material, and the maximum voltage value for said imaged portion is set so that the maximum voltage value in a last image transferring operation is greater than the maximum voltage value in a first image transferring operation, and the maximum voltage value in a certain transferring operation does not become smaller than the maximum voltage value in a last image transferring operation.

20. An image forming apparatus according to claim 17 or 19, further comprising a recording material bearing means for bearing the recording material, wherein the image is transferred from said image bearing member to the recording material born on said recording material bearing means at said transfer station.

21. An image forming apparatus according to claim 20, wherein said recording material bearing means comprises a recording material bearing sheet for bearing the recording material, and a supporting member for supporting said recording material bearing sheet and extending in a direction perpendicular to a shifting direction of said recording material bearing means.

22. An image forming apparatus according to claim 20, wherein said transfer means can be contacted with an inner side of said recording material bearing means.

23. An image forming apparatus according to claim 19, wherein the maximum voltage value of said non-imaged portion is so set that the maximum voltage value in the last image transferring operation is greater than the maximum voltage value in the first image transferring operation, and the maximum voltage value in a certain transferring operation does not become smaller than the maximum voltage value in a next transferring operation.

24. An image forming apparatus according to claim 19, wherein the image forming apparatus can form a full-color image on the recording material.

25. An image forming apparatus according to claim 17, wherein the maximum voltage value of at least one of said imaged and non-imaged portions is controlled in accordance with an environmental condition.

26. An image forming apparatus comprising:

an image bearing member for bearing an image thereon; and transfer means for transferring the image from said image bearing member to a recording material at a transfer station, said transfer means being controlled under a constant voltage;

wherein a maximum current value applicable to said transfer means is set smaller when a non-imaged portion of said image bearing member is in the transfer station than when an imaged portion of said image bearing member is in the transfer station.

* * * * *

UNITED STATES PATENT AND TRADEMARK OFFICE

CERTIFICATE OF CORRECTION

PATENT NO. : 5,600,421

DATED : February 4, 1997

INVENTOR(S) : Nobuhiko TAKEKOSHI, et al.

It is certified that error appears in the above-indentified patent and that said Letters Patent is hereby corrected as shown below:

COLUMN 1:

Line 59, "born" should read --borne--.

COLUMN 2:

Line 25, "born" should read --borne--;

Line 62, before "an", insert --in--.

COLUMN 3:

Line 15, delete "by";

Line 60, "born" should read --borne--.

COLUMN 4:

Line 11, before "the", second ocurrence, insert --of--.

COLUMN 5:

Line 23, "fcurth" should read --fourth--;

Line 43, delete "applied", first occurrence;

Line 53, delete "of".

COLUMN 6:

Line 5, "born" should read --borne--;

Line 12, "do" should read --doing--;

Line 32, "born" should read --borne--.

COLUMN 8:

Line 16, "an" 1st occurrence should read --is--.

Line 35, delete "a", second occurrence.

UNITED STATES PATENT AND TRADEMARK OFFICE

CERTIFICATE OF CORRECTION

PATENT NO. : 5,600,421
DATED : February 4, 1997
INVENTOR(S) : Nobuhiko TAKEKOSHI, et al.

It is certified that error appears in the above-indentified patent and that said Letters Patent is hereby corrected as shown below:

COLUMN 9:

Line 2, "born" should read --borne--;
Line 58, "tht" should read --the--.

COLUMN 10:

Line 57, "sensor, but" should read --sensor;-- and after "serviceman", insert --may--.

COLUMN 11:

Line 63, "28" should read --28a--.

COLUMN 12:

Lines 3 and 5, "28" should read --28a--;
Line 5, delete "of";
Line 28, delete "is";
Line 33, "pcrtions" should read --portions--;
Line 34, "the" should read --an--;
Line 36, after "while", insert --in the--;
Line 37, delete "that";
Line 65, "born" should read --borne--.

UNITED STATES PATENT AND TRADEMARK OFFICE

CERTIFICATE OF CORRECTION

PATENT NO. : 5,600,421
DATED : February 4, 1997
INVENTOR(S) : Nobuhiko TAKEKOSHI, et al.

It is certified that error appears in the above-indentified patent and that said Letters Patent is hereby corrected as shown below:

COLUMN 13:

Line 2, "born" should read --borne--.

Signed and Sealed this

Fifth Day of August, 1997

Bruce Lehman

*Attest:*

BRUCE LEHMAN

*Attesting Officer*

*Commissioner of Patents and Trademarks*